US011284685B2

(12) United States Patent
Garcia et al.

(10) Patent No.: US 11,284,685 B2
(45) Date of Patent: Mar. 29, 2022

(54) OPENABLE FINGER RING SYSTEM

(71) Applicants: Guaicaipuro Rodriguez Garcia, Surrey (CA); Blanca Yanina Simon, Surrey (CA)

(72) Inventors: Guaicaipuro Rodriguez Garcia, Surrey (CA); Blanca Yanina Simon, Surrey (CA)

( * ) Notice: Subject to any disclaimer, the term of this patent is extended or adjusted under 35 U.S.C. 154(b) by 164 days.

(21) Appl. No.: 15/673,221

(22) Filed: Aug. 9, 2017

(65) Prior Publication Data

US 2019/0045890 A1 Feb. 14, 2019

(51) Int. Cl.
*A44C 9/00* (2006.01)

(52) U.S. Cl.
CPC ..... *A44C 9/0046* (2013.01); *A44C 9/0038* (2013.01)

(58) Field of Classification Search
CPC ..... A44C 5/18; A44C 5/2047; A44C 5/2076; A44C 5/22; A44C 5/24; A44C 5/0084; A44C 5/0092; A44C 9/0007; A44C 9/003; A44C 9/0038; A44C 9/00; A44C 9/0046; Y10T 24/45052; Y10T 24/1473; Y10T 24/45215; Y10T 24/45241; Y10T 24/1471; Y10T 24/4718; Y10T 24/4782; F16B 2/10
See application file for complete search history.

(56) References Cited

U.S. PATENT DOCUMENTS

| | | | | | |
|---|---|---|---|---|---|
| 1,296,435 | A * | 3/1919 | Schmidt | A44C 9/02 | 63/15.5 |
| 2,971,354 | A * | 2/1961 | Beizer | A44C 9/02 | 63/15.5 |
| 3,465,543 | A * | 9/1969 | Baker | A44C 9/02 | 63/15.5 |
| 3,566,616 | A * | 3/1971 | Benedict, Jr. | A44C 9/0038 | 63/15.7 |
| 4,790,148 | A * | 12/1988 | Faini | A44C 9/0038 | 24/574.1 |
| 4,815,180 | A * | 3/1989 | Elsener | A44C 5/2033 | 24/616 |
| 4,879,883 | A | 11/1989 | Bruner | | |
| 4,991,409 | A * | 2/1991 | Creates | A44C 9/0046 | 63/15.7 |
| 5,186,023 | A * | 2/1993 | Goldberg | A44C 9/0038 | 63/15.5 |
| 5,651,273 | A | 7/1997 | Levy | | |
| 7,017,368 | B2 | 3/2006 | Hug | | |
| 7,107,789 | B1 | 9/2006 | Bruner | | |
| 7,845,077 | B1 * | 12/2010 | Alulis | A44C 27/00 | 29/896.412 |
| 2002/0129619 | A1 * | 9/2002 | Wolff | A44C 9/0038 | 63/7 |

* cited by examiner

*Primary Examiner* — Emily M Morgan
(74) *Attorney, Agent, or Firm* — Argus Intellectual Enterprise; Daniel Enea; Jordan Sworen

(57) ABSTRACT

An openable finger ring system includes a ring configured to be worn around a finger of a user. The ring comprises a first-arcuate member, a second-arcuate member, a hinge, and a fastener in functional combination. The first-arcuate member and the second-arcuate member may be hingedly coupled via the hinge creating a continuous circular the ring for encircling the finger of the user when secured for use. The openable finger ring system provides a ring which accommodates removal and donning of rings on inflamed fingers.

3 Claims, 5 Drawing Sheets

OPENABLE FINGER RING SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of rings and more specifically relates to an openable finger ring system.

2. Description of Related Art

A ring is a round band, usually of metal, worn as an ornamental piece of jewelry around the finger. Due to arthritis and other conditions causing inflammation of the knuckles, putting on or removing a finger ring is nearly impossible. Typically, the inflamed knuckle is 3-4 sizes larger than the finger near the base where the ring sits. A suitable solution is desired.

U.S. Pat. No. 4,879,883 to Mates A. Bruner relates to an openable ring with unique locking and release means. The described openable ring with unique locking and release means includes a ring to be worn as an article of jewelry about a portion of a body of a person has pivotally mounted, first and second arcuate sections movable between opened and closed positions. A substantially T-shaped recess is provided in the first arcuate section. This recess extends along a portion of the arc of the first arcuate section and includes an outer head portion of a wider transverse dimension than an inner stem portion. The head and stem portions of the recess are joined through upwardly facing, transversely extending supporting surfaces. The recess further has an open free end, and the stem portion of the recess includes an opening along the arcuate inner surface of the first arcuate section for communicating with the interior of the ring. The second arcuate section has an inner surface and a rigid male extending male member projecting therefrom. The male member includes a distal portion having a transverse dimension receivable within the stem portion of the recess and a proximal portion having a substantially T-shaped transverse configuration providing downwardly facing surfaces which overlie the transversely extending supporting surfaces of the recess when the arcuate sections are in a fully closed position. In a preferred embodiment of this invention a latching member is provided for maintaining the male extending member in a position fully inserted within the recess when the arcuate sections are in a fully closed position, and the latching member is operable to both release the locking engagement thereof and to apply a biasing force between the first and second sections in a direction to move the arcuate sections into an opened position. The latching member also forms a part of this invention.

BRIEF SUMMARY OF THE INVENTION

In view of the foregoing disadvantages inherent in the known ring art, the present disclosure provides a novel openable finger ring system. The general purpose of the present disclosure, which will be described subsequently in greater detail, is to provide an openable finger ring for accommodating removal and donning of rings.

An openable finger ring system is disclosed herein. The openable finger ring system includes a ring configured to be worn around a finger of a user. The ring comprises a first-arcuate member, a second-arcuate member, a hinge, and a fastener in functional combination. The first-arcuate member and the second-arcuate member may be hingedly coupled via the hinge creating a continuous circular ring for encircling the finger of the user when secured for use. The fastener may include a female-fastener and a male fastener comprising a S-shaped grooved channel and a bar respectively. The fastener provides releasable locking means for the first-arcuate member and the second-arcuate member. The ring is configured to open and close via the hinge and the fastener with applied force. The second-arcuate member comprises a cavity portion for receiving a t-shaped distal end of the first-arcuate member.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an openable finger ring system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to rings and more particularly to an openable finger ring system as used to improve the removal and donning of a ring when knuckles are inflamed.

Generally, the present invention provides a ring which is designed to accommodate the removal and donning of a ring when knuckles are inflamed. The ring is openable and pivots on a hinge for opening and closing of the ring. This invention solves this issue without having to cut off the ring and destroy what some would consider their most precious asset.

Figure 1:
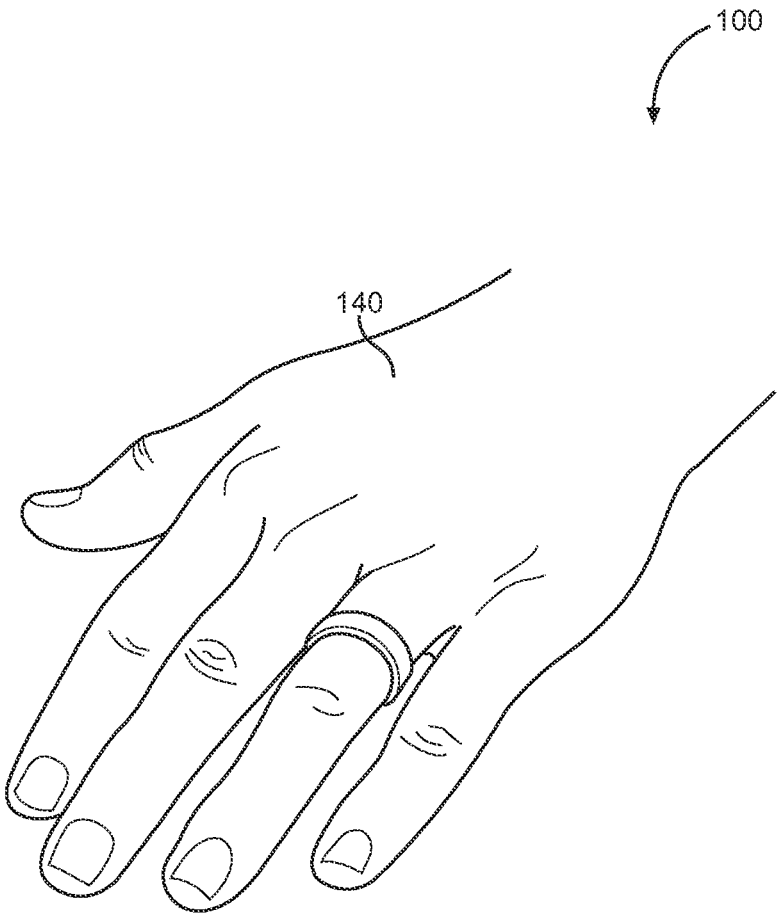
FIG. 1 is a perspective view of the openable finger ring system during an 'in-use' condition, according to an embodiment of the disclosure.

Referring now more specifically to the drawings by numerals of reference, there is shown in FIGS. 1-5, various views of an openable finger ring system 100. FIG. 1 shows an openable finger ring system 100 during an 'in-use' condition 150, according to an embodiment of the present disclosure. As illustrated, the openable finger ring system 100 may include a ring 110 configured to be worn around a finger of a user 140. The ring 110 may comprise a first-arcuate member 120, a second-arcuate member 130, a hinge 160, and a fastener 170.

Figure 2:
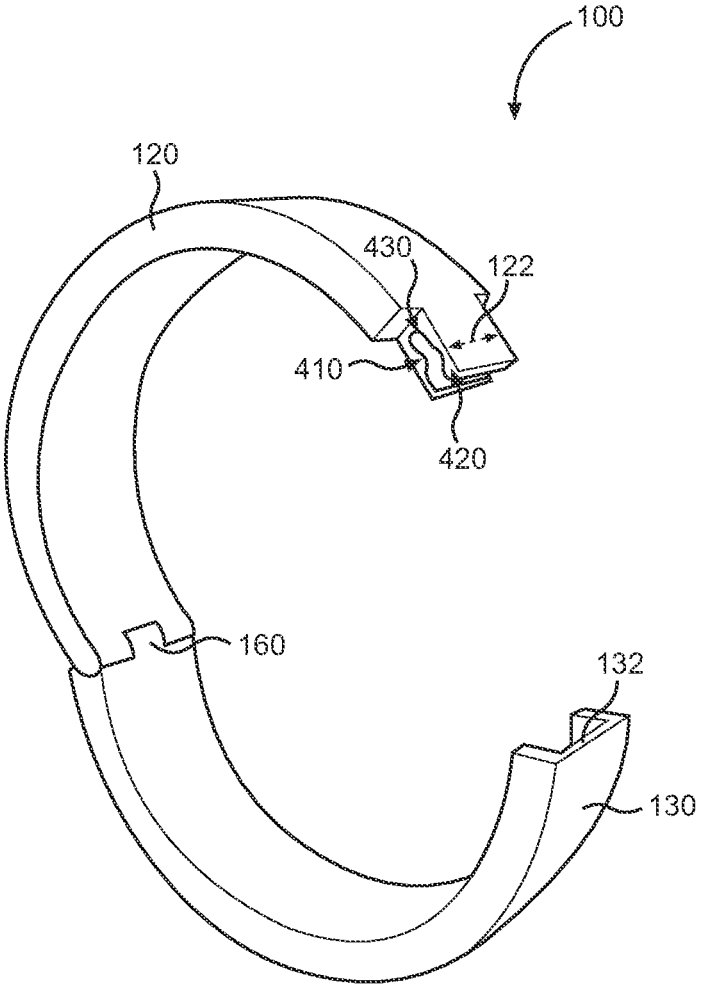
FIG. 2 is a perspective view of the openable finger ring system of FIG. 1, according to an embodiment of the present disclosure.

FIG. 2 shows a perspective view of the openable finger ring system 100 of FIG. 1, according to an embodiment of the present disclosure. As above, the openable finger ring system 100 may include a ring 110 having a first-arcuate member 120, a second-arcuate member 130, a hinge 160, and a fastener 170. The ring 110 may comprise the first-arcuate member 120, the second-arcuate member 130, the hinge 160, and the fastener 170 in functional combination. The first-arcuate member 120 and the second-arcuate member 130 are hingedly coupled via the hinge 160 creating a continuous circular ring 110 for encircling the finger of the user 140 when secured for use. The fastener 170 provides releasable locking means for the first-arcuate member 120 and the second-arcuate member 130. The ring 110 is configured to open and close via the hinge 160 (or other suitable equivalent means for rotating) and the fastener with applied force. The second-arcuate member 130 comprises a cavity portion 132 for receiving a t-shaped distal end 122 of the first-arcuate member 120. Detail of the distal end 122 is shown inset, with S-shaped grooved channel 180 showing protrusions 410 and 420 on opposite sides.

Figure 3:
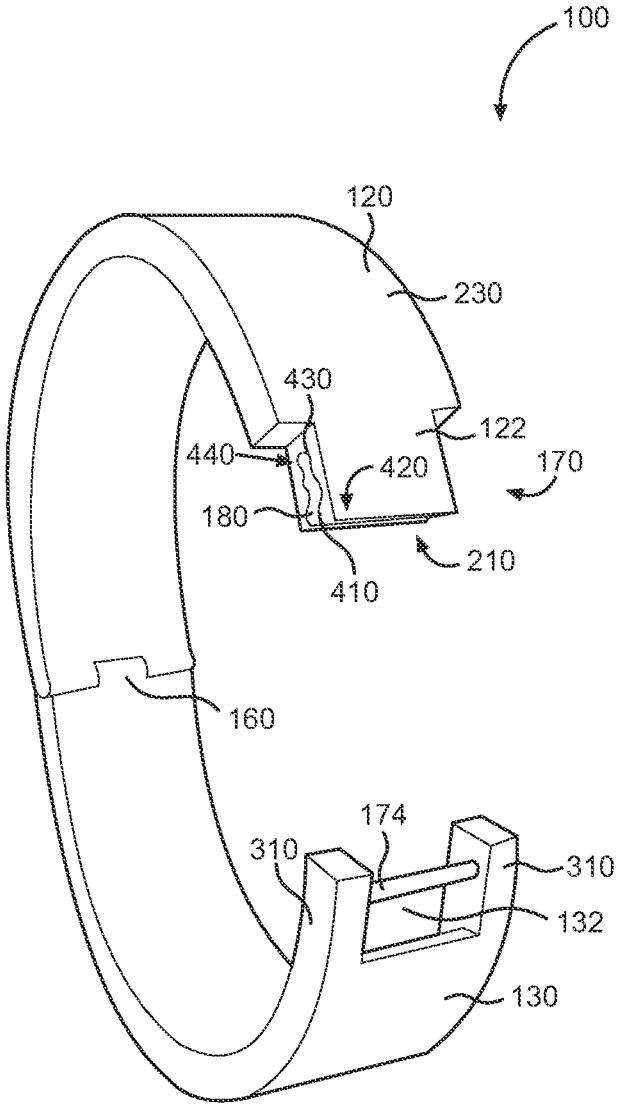
FIG. 3 is a perspective view of the openable finger ring system of FIG. 1, according to an embodiment of the present disclosure.

FIG. 3 shows a perspective view of the openable finger ring system 100 of FIG. 1, according to an embodiment of the present disclosure. As above, the openable finger ring system 100 may include a ring 110 having a first-arcuate member 120, a second-arcuate member 130, a hinge 160, and a fastener 170. The ring 110 may be rigid and provides means for accommodating removal and donning of a ring 110 when knuckles and fingers are swollen. The fastener 170 may comprise a male-fastener 172 and a female-fastener 178. The male-fastener 172 is positioned on the second-arcuate member 130 on an opposing end to the hinge 160. The female-fastener 178 of the t-shaped distal end 122 is positioned on the first-arcuate member 120 on an opposing end to the hinge 160. The female-fastener 178 may comprise a S-shaped grooved channel 180 for engaging and friction-holding a bar 174 of the male-fastener 172 and an open-end, the male-fastener 172 able to engage into and egress from the open-end as desired. Other shapes/profiles of the bar 174 may be used.

Figure 4:
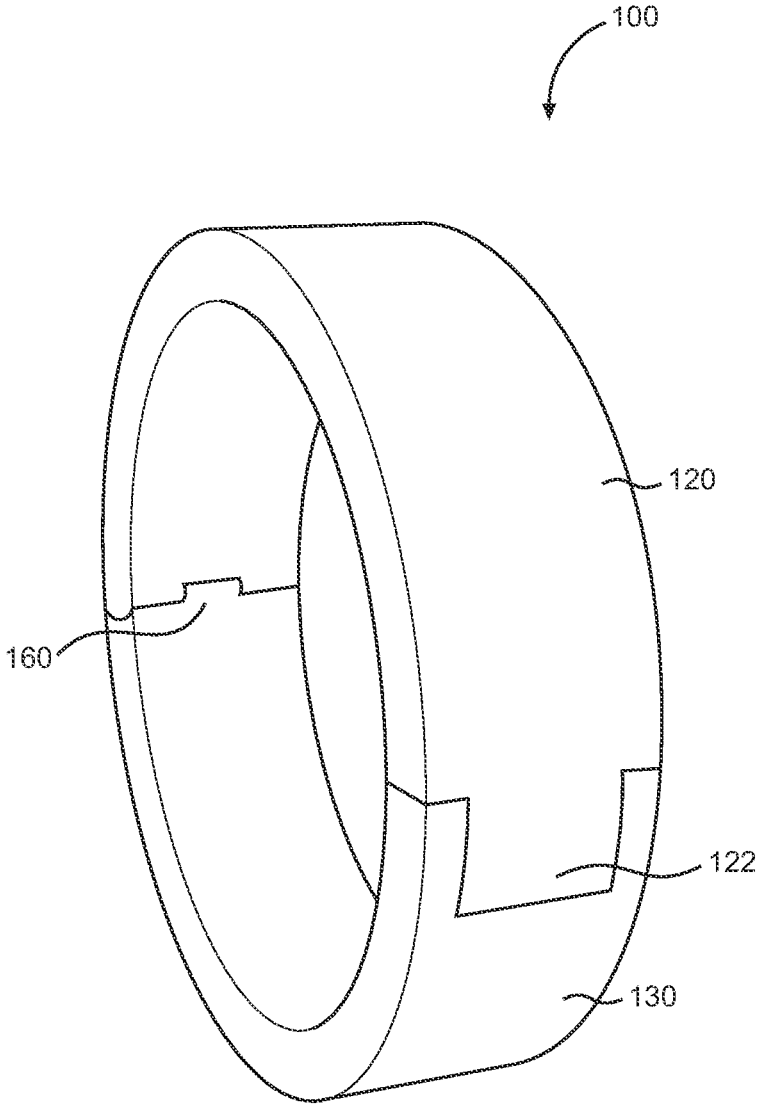
FIG. 4 is a perspective view of the openable finger ring system of FIG. 1, according to an embodiment of the present disclosure.

FIG. 4 shows a perspective view of the openable finger ring system 100 of FIG. 1, according to an embodiment of the present disclosure. As above, the openable finger ring system 100 may include a ring 110 having a first-arcuate member 120, a second-arcuate member 130, a hinge 160, and a fastener 170. The bar 174 is positioned adjacent the cavity portion 132 of the second-arcuate member 130 comprising the male-fastener 172. The bar 174 is positioned at a back end of the S-shaped grooved channel 180 (substantially S-shaped) when in a closed in-use condition. The cavity portion 132 comprises a depth suitable for receiving the t-shaped distal end 122 of the first-arcuate member 120 creating a smooth outer surface of the ring 110 when engaged. The first-arcuate member 120 and the second-arcuate member 130 are manually separated via the applied force moving the bar 174 back through the S-shaped grooved channel 180 and separating the male-fastener 172 and the female-fastener 178. The bar 174 when in the closed in-use condition is secured within the S-shaped grooved channel 180 and friction-fitted. The first-arcuate member 120 and the second-arcuate member 130 having a thickness forming a cylindrical profile when engaged.

Figure 5:
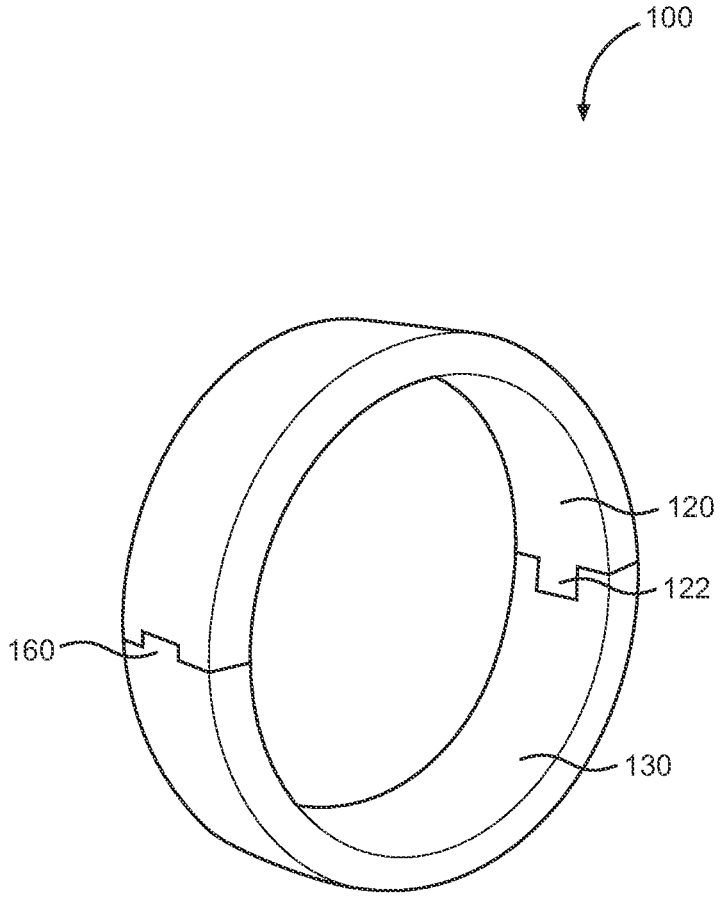
FIG. 5 is a perspective view of the openable finger ring system of FIG. 1, according to an embodiment of the present disclosure.

FIG. 5 shows a perspective view of the openable finger ring system 100 of FIG. 1, according to an embodiment of the present disclosure. As above, the openable finger ring system 100 may include a ring 110 having a first-arcuate member 120, a second-arcuate member 130, a hinge 160, and a fastener 170. The S-shaped grooved channel 180 runs along a width of the t-shaped distal end 122 suitable for receiving the bar 174 positioned along a width of the cavity portion 132. The bar 174 is positioned along a width of the cavity portion 132 at a most distal end of the male-fastener 172.

The first-arcuate member 120 and the second-arcuate member 130 are in the closed in use condition (FIGS. 1, 4, 5) when the bar 174 is maneuvered into the closed end 430 of the S-shaped grooved channel 180 and the t-shaped distal end 122 is mated within the cavity portion 132. When the t-shaped distal end 122 and the cavity portion 132 are flush when the bar 174 is maneuvered into the closed end 430 of the S-shaped grooved channel 180 creating a virtually seamless and continuous the outer surface of the ring 110.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An openable finger ring system configured to be worn around a finger of a user, the openable finger ring system comprising:

a first-arcuate member having a first end having a T-shape, and a second end;

a second-arcuate member having a first end, and a second end having two arms;

a hinge connecting the second end of the first-arcuate member to the first end of the second-arcuate member, such that the first-arcuate member and the second-arcuate member are rotatable;

the first end of the first-arcuate member comprises:

a distal end having a width that is laterally narrower than a proximal portion of the first-arcuate member, which forms the T-shape, the distal end including an S-shaped groove that extends along a circumference of the first arcuate member, the S-shaped groove having a closed end and an open end, two opposite sides, and a width equal to that of the distal end, the S-shaped groove further comprising one protrusion on each side, the second end of the second-arcuate member comprises:

each arm extending along opposite lateral sides forming a cavity therebetween, a bar extending between the pair of arms, the bar is slidable within the S-shaped groove;

a closed configuration, wherein the T-shaped first end is between the two arms and the bar abuts the closed end of the S-shaped groove, forming a continuously enclosed finger aperture adapted to receive a finger; and an open configuration wherein the T-shaped first end is removed from between the two arms and the bar is removed from the S-shaped groove.

2. The openable finger ring system of claim 1, wherein said bar is parallel to a central axis of said openable finger ring system.

3. The openable finger ring system of claim 1, wherein in the closed configuration, an exterior surface of both the first and second arcuate members are flush.

* * * * *